United States Patent [19]

Hubert

[11] 3,941,993

[45] Mar. 2, 1976

[54] ILLUMINATING DEVICE IN PARTICULAR FOR AN OPERATING TABLE

[75] Inventor: Jean Hubert, Romainville, France

[73] Assignee: C G R Alexandre, Romainville, France

[22] Filed: Oct. 9, 1974

[21] Appl. No.: 513,408

[30] Foreign Application Priority Data

Oct. 12, 1973 France ..... 73.36610

[52] U.S. Cl...... 240/1.4; 240/41.15; 240/106 R

[51] Int. Cl.[2]..... A61G 13/00; F21V 5/02

[58] Field of Search ..... 240/1.4, 41.15, 106, 106.1, 240/41.3, 41.4

[56] References Cited

UNITED STATES PATENTS

| | | | |
|---|---|---|---|
| 2,827,554 | 3/1958 | Gunther et al. | 240/1.4 |
| 3,225,184 | 12/1965 | Reiber | 240/1.4 |
| 3,360,640 | 12/1967 | Seitz et al. | 240/1.4 |
| 3,732,417 | 5/1973 | Nordquist | 240/106.1 |

FOREIGN PATENTS OR APPLICATIONS

| | | | |
|---|---|---|---|
| 1,495,007 | 8/1967 | France | 240/1.4 |

*Primary Examiner*—Richard L. Moses
*Attorney, Agent, or Firm*—Edwin E. Greigg

[57] ABSTRACT

An illuminating device which employs prisms to concentrate light onto an operating area or field.

The prisms are formed by an assembly of straight prism-segments which are combined into radial sectors the angular extent of which is such that the beams issuing from the source are reflected onto the field to form an area of approximately the same width as the field. Each sector thus illuminates the whole of the field, resulting in a great uniformity of illumination.

Applicable to the illumination of operating tables and in general to the illumination of cavities and their walls.

4 Claims, 9 Drawing Figures

O
D'
D
B'
M
B
C'
A'
A
C
d'
d'''
d''
b'
c'
a'
m
o'
d
22
b
c
a'''
a''
21
a

ILLUMINATING DEVICE IN PARTICULAR FOR AN OPERATING TABLE

The invention relates to an illuminating device, particularly for an operating table, and more particularly to such a device which uses prisms rather than mirrors to concentrate the light rays onto the operating area or field.

Such a device is usually in the form of a body of revolution about an axis, and the light emitted by the source or sources is redirected by a toroidal optical system onto the plane of the prisms in substantially parallel layers, the prisms being arranged concentrically with the axis in a plane normal thereto.

Figure 1:
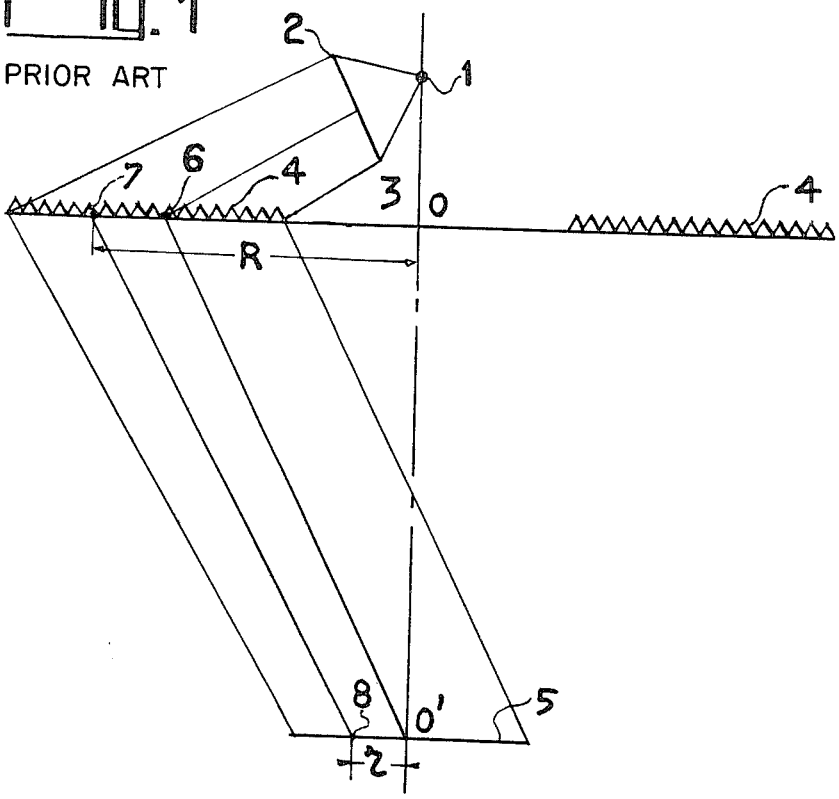
FIG. 1 PRIOR ART

A cross-section of a prior art illuminating device which employs prisms is shown in FIG. 1. At 1 is situated a source, which is as nearly a point-source as possible, the light from which is refracted by the toroidal optical system 2 (only the rays and the part of this optical system situated on the left-hand side are shown) and is directed in substantially parallel layers onto a plate 3, which carries a large number of circular annular prisms 4 forming a ring arrangement of centre 0. These prisms are so orientated as to receive the rays emitted by the optical system 2 normally to one face. The angle at their apex is so calculated that, as a result of total reflection and then refraction on emerging from their third face, the incident rays are redirected in the desired direction. The angle at the apex of the prisms may thus vary from one prism to another but, in practice, the prisms are split up into groups all of which have the same angle. The light beams reflected by the rings of prisms is thus redirected onto an operating field 5 of centre O′, the width of which may be adjusted by means of the angles of the prisms. Only one source 1 is shown but it is understood that there may be a number of sources each of which is assigned to one annular band consisting of a number of concentric prisms.

This arrangment is unsatisfactory since the illumination on the operating field is insufficiently uniform.

Figure 2:
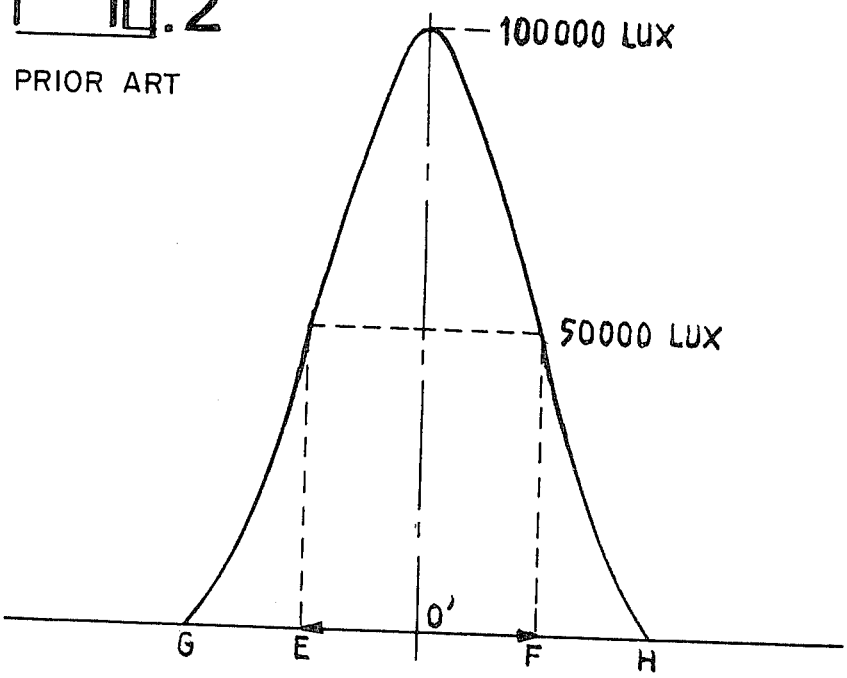
FIG. 2 PRIOR ART

In FIG. 2 is shown a diagram of the illumination of the field as a function of distance from its centre O′. Assuming that the operating field requires an illumination of 50,000 lux, it can be seen that the illumination at the centre will easily reach twice this value, i.e., 100,000 lux. It is even possible that at one very small point, one smaller than a light meter is capable of sensing, the illumination will be even more intense. The reason for this phenomenon can be understood; the circular prisms reflect all the rays towards the centre and in particular the centre receives all the luminous flux reflected by a certain prism, as indicated by reference numeral 6 in FIG. 1. In general terms, if R is the radius of circular prism 7 whose centre is O and $r$ is the distance between the centre O′ and the point 8 of the field onto which is reflected the beam which strikes the said prism, the illumination at point 8 would be a function of the ratio $R/r$. It can thus be seen that the illumination at centre O′ should theoretically be infinite. This non-uniformity also results in an abrupt drop in illumination outside the field. In this case the field-width EF was 70 millimeters and at twice the distance away from the centre O′, at point G and H, the illumination was practically zero.

The objet of the invention is to provide an illuminating device which employs concentrating prisms and in which the illumination of the field is substantially uniform.

According to a feature of the invention, in an illuminating device which employs prisms for concentrating light, the prism assembly is formed by juxtaposing a plurality of straight prism-segments in such a way that the light emitted by a source is not concentrated onto the axis of the system but is simply reflected towards the field, without being concentrated in any other way than by the superimposition of the light beams reflected by the various prism segments.

In accordance with another feature, the prism segments are combined into radial sectors the angular extent of which is such that the beams from the source are reflected onto the field to form a trace of which the width is approximately the same as the width of the field.

The invention will be better understood and other features will become apparent from the following description of a preferred embodiment, which is given with reference to FIGURES which show:

FIG. 1, a diagrammatic cross-section through a prior art illuminating device which employs circular annular prisms, FIG. 2, a diagram of the field of illumination obtained with this device, shown in FIG. 1.

Figure 3:
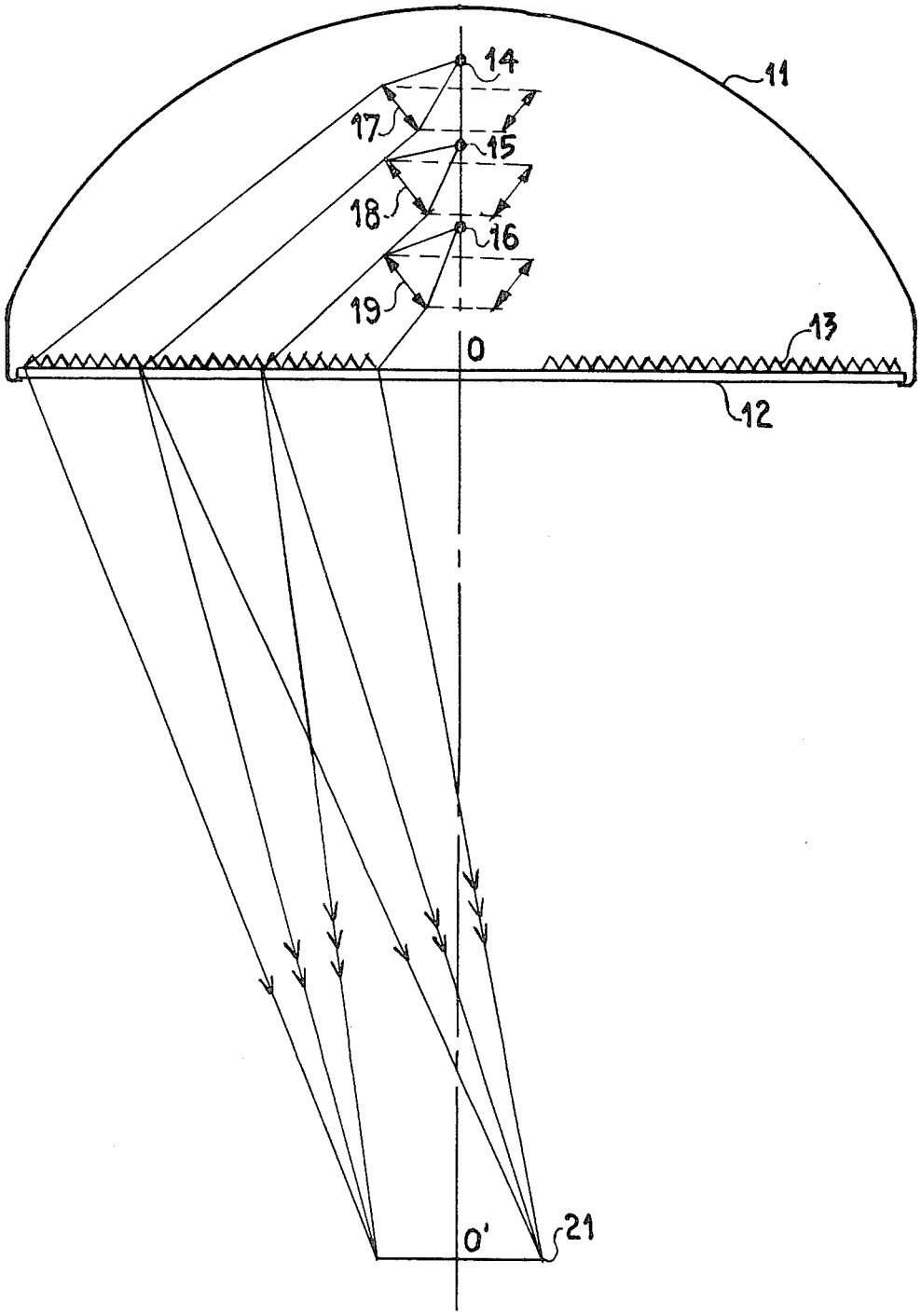
Figure 4:
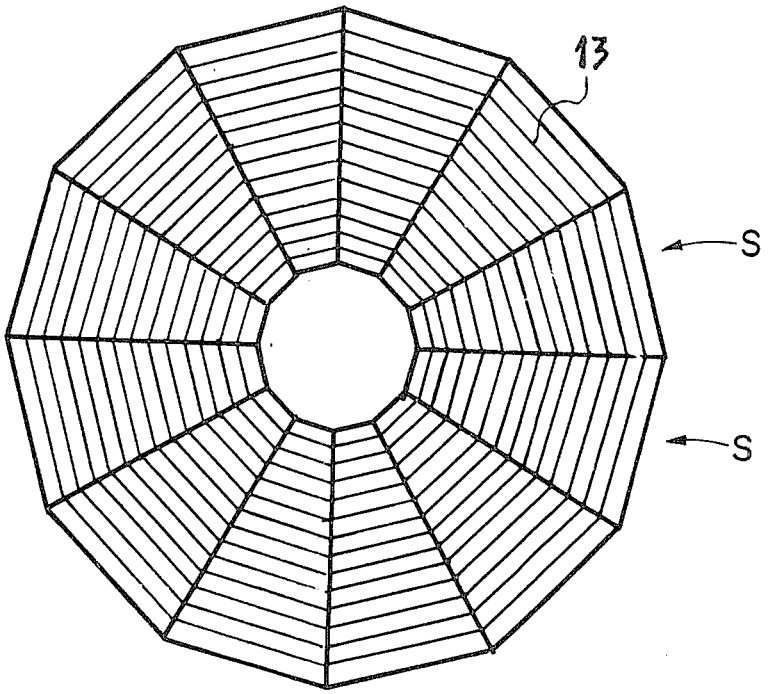
Figure 6:
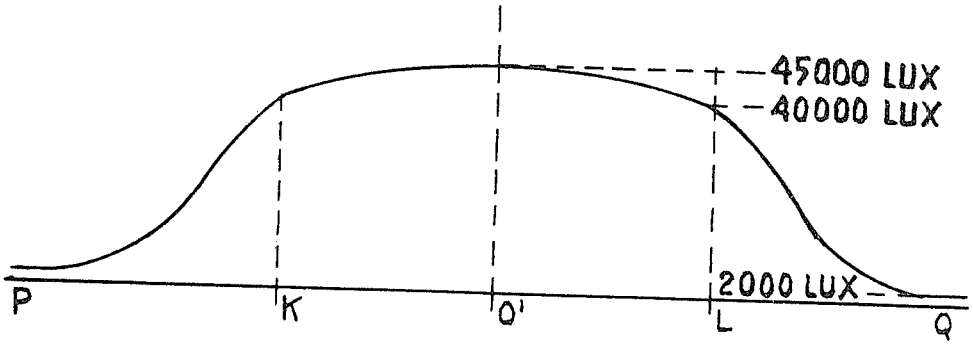
Figure 5:
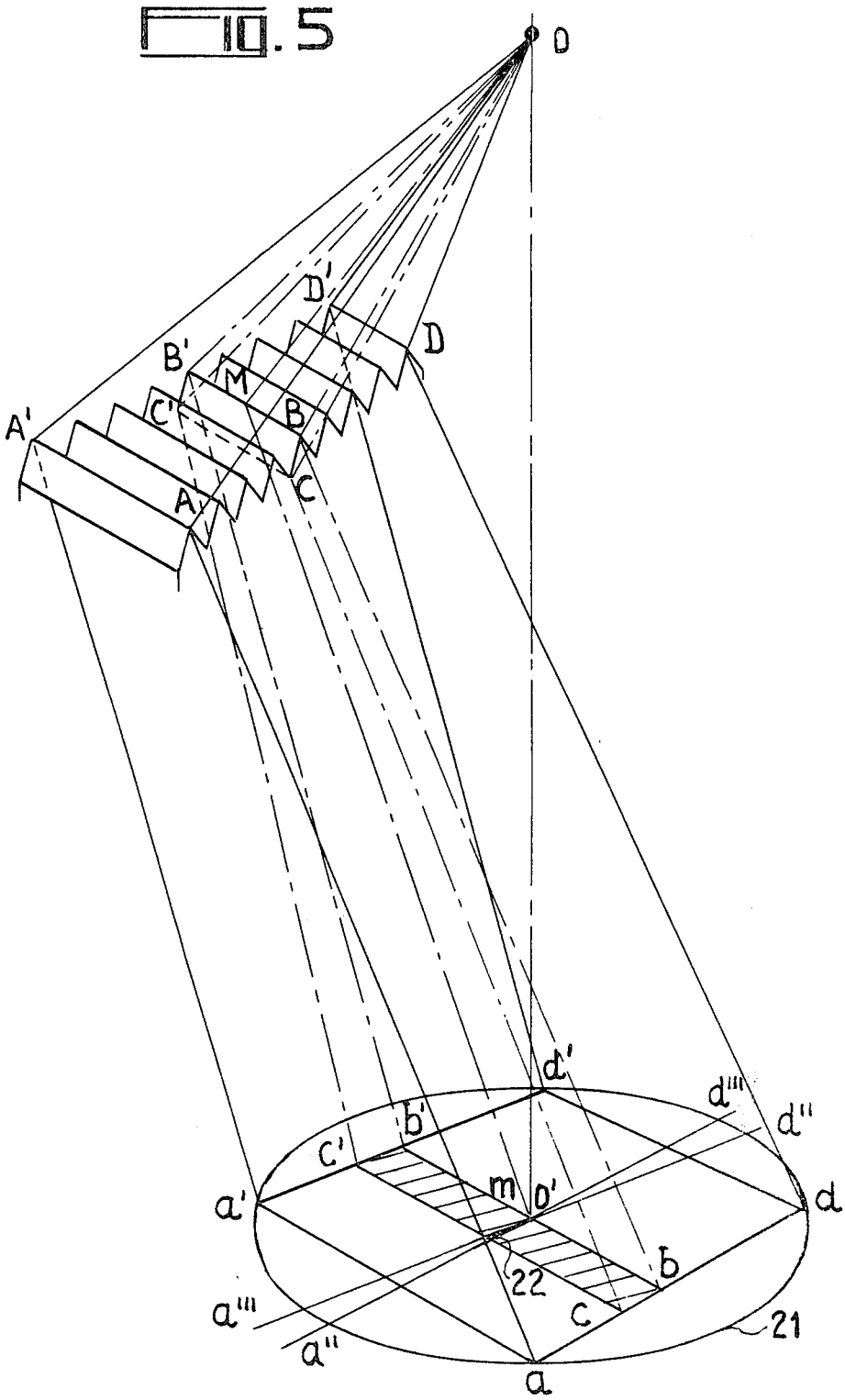
Figure 7A:
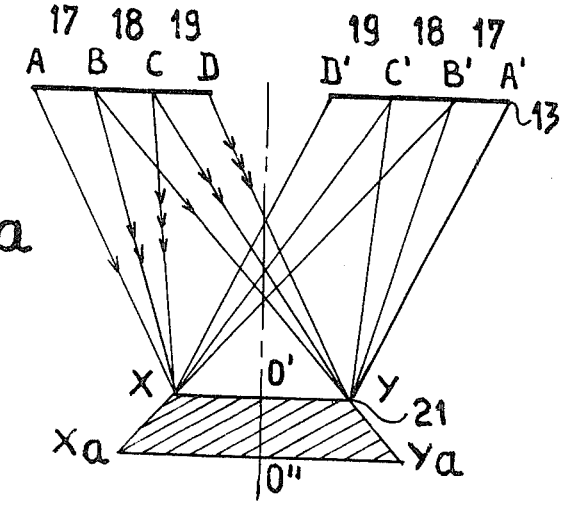
Figure 7B:
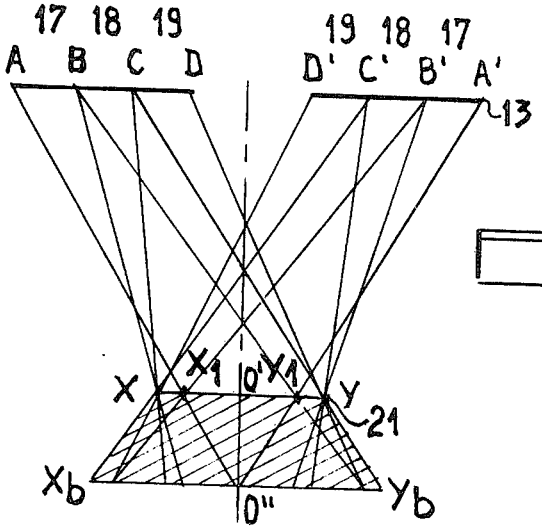
Figure 7C:
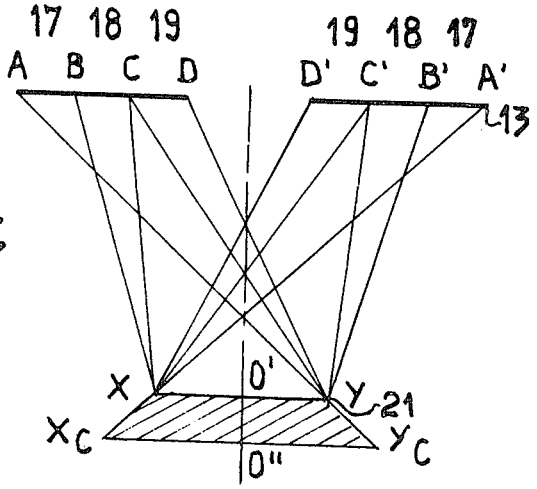

FIG. 3, a diagrammatic cross-section through a device according to the invention, FIG. 4, a plan view of the prism segments, FIG. 5, a perspective view of a prism sector showing the paths of the rays, FIG. 6, a diagram of the field of illumination with a device according to the invention, FIGS. 7*a* , 7*b* and 7*c*, diagrams of the paths of the light rays in the case of three characteristic configurations.

FIG. 1, and 2, which were discussed above, relate to a prior art illuminating device.

FIG. 3 is a diagrammatic view, in axial cross-section, of a device according to the invention. The device forms a body of revolution about axis O, O′. A bell-shaped cover 11 supports a transparent, flat circular plate 12, of plastic material for example, the centre of which is O and which supports a prism assembly made up from a plurality of juxtaposed rectilinear prisms 13. Above this plate 12 are secured one or more light sources 14, 15 and 16, which are generally formed by miniature iodine filament-lamps. The luminous flux emitted by the source or sources is concentrated by an equal number of toroidal optical systems 17, 18, 19 onto prisms 13.

FIG. 4 shows the assembly of prisms 13 in plan. It can be seen that the individual prisms are straight and are grouped into a certain number of sectors. Twelve sectors are shown but, in fact, their number can be greater. The prisms are so orientated as to receive the luminous flux originating from the toroidal optical systems perpendicularly to their faces. The light rays enter the prisms, are totally reflected by the opposite face, and are refracted by the exit face. The orientation of the prism and their apex angle varies from one prism to another to allow them to reflect the rays in the desired direction. In practice, the angles of a number of adjoining prisms are sufficiently similar in size to enable the whole of one prism group to have the same apex angle, which simplifies machining. In the left-hand part of FIG. 3 is shown a set of beam paths. The angles of the prisms are so calculated in this case that the beam emanating from each source is reflected onto practically the whole of the field 21 of centre O', but it is understood that the angles may be so calculated as to enable the beam to be reflected onto different areas of the field, such as smaller areas which partially overlap.

FIG. 5 illustrates the beam paths in greater detail. It is assumed that the light originates from a single point-source situated at O. In actual fact the angular extent of the beams from the toroidal optical systems is small, being of the order of 5°, due to the fact that the sources are not point-sources, but the characteristics of the beam paths are similar. A prism sector AA', DD' as shown in FIG. 4 is shown in perspective. The angles of the prisms are so calculated as to allow the light to be reflected over substantially the whole area of the field 21. It can be seen that the projection of sector AA' DD' onto plane 21 is substantially a trapezoid *aa'*, *dd'*. If a particular prism is considered, whose reflecting face BB' CC' directs light towards the centre of field 21, it can be seen that the projection of this face onto the field is a quadrilateral *bb'*, *cc'* and that a point M for example, which is situated at the centre of the crest BB' of the prism, redirects the light onto a point *m* situated at the centre of *bb'*. If it is assumed that point *m* is situated at the centre O' of field 21, it can be seen that illumination in the vicinity of point *m* is equal to the illumination over the whole of the quadrilateral *bb' cc'*.

If, while still that point *m* is situated at centre *O'*, the prisms were arcs of a circle of centre *O*, instead of being straight, the points *B* and *B'* situated on the same crest as *M* would both focus onto point *O'*, whereas the sector *AA'*, *DD'*, assuming it to be of the same size as in the case of the straight prisms, would be projected onto field 21 in the form of substantially two sectors *a.. o' a'''*, and *d'' o' d'''* which are opposed at the apex and whose angular extent corresponds to that of sector AA', DD'. It can be seen that in the latter case, all the luminous flux reflected by prism BB', CC' is concentrated on a sector 22 which is marked in black on the figure, the sector being of the same angular extent and having a radius corresponding to the width of the prism, and it can also be seen that all the flux which strikes the prism in the vicinity of the crest BB' is concentrated onto point O', thus giving a theoretically infinite illumination at this point.

In the device according to the invention, each sector of straight prisms produces on field 21 a quadrilateral area of illumination similar to quadrilateral *aa'*, *dd'* but which is shifted by an angle equal to the angular extent of the sector. It can be seen that this superimposition of the various angularly shifted quadrilaterals improves even further the uniformity of illumination.

Another advantage of this superimposition of the quadrilateral areas of illumination becomes apparent when an opaque obstruction masks the field. If it is assumed that the obstruction masks one sector of prisms, in the case of the circular prisms the illumination in the corresponding sector of the field is reduced by half, where as in the case of straight prisms the illumination over the whole area of the field is reduced by a fraction equal to the reciprocal of the number of prism sectors since each of the sectors illuminates the whole of the field.

Like FIG. 2, FIG. 6 shows a diagram of the illumination of a field, but in this case it is one illuminated by a device according to the invention rather than by a prior art device fitted with circular prisms. It can be seen that illumination is practically constant over the whole extent of the field, i.e., is 45,000 lux at the centre and 40,000 at the edges. Another advantage of this system is that it extends illumination beyond the edges of the field. The slope of the curve representing illumination is smaller at points K and L in FIG. 6 than at points E and F in FIG. 2, which is to say that illumination at the outer fringes of the field falls less swiftly with straight prisms than with circular prisms.

The purpose of this device is principally to illuminate operating fields. In this case the problem is not simply to illuminate an area, in such a way as to avoid shadows, but also to illuminate a cavity and in particular its walls. It is therefore important that the light beams should strike the field at the most oblique angle possible.

Furthermore, the oblique angles at which the light beams are concentrated onto the surface of the field makes it necessary for the device to be positioned at a given distance from the field in order to obtain the desired illumination. If this optimum position is departed from, the light spot increases in area, to the detriment of illumination. For ease of operation, it is desirable that the beams should be as little oblique as possible so that the distance at which the device is used can be varied whilst still providing sufficient illumination.

These two contradictory requirements make a compromise necessary. An advantage of the invention, which makes it possible to orientate the reflection of each prism in any direction whatsoever without causing irregularities in the distribution of the light over the field in a non-uniform manner, is that it allows a large number of reflective configurations.

FIG. 7 shows three typical configurations diagrammatically.

FIG. 7*a* relates to the configuration in FIG. 3. In it are seen three groups of prisms AB, BC, CD together with their symmetrical counterparts A'B', B'C', C'D'. These receive three beams 17, 18 and 19 from three sources which are not shown. Each beam is reflected onto the whole of field XY. When field XY is moved towards or away from the plane of prisms 13, illumination decreases as the illuminated area increases. It has been found by experiment that illumination remains adequate over the whole of the field down to a level $X_a$ $Y_a$ for instance. There is also another limit between field XY and the device at which illumination is adequate but a position for the field above line XY would not appear suitable for use, because of the fact that walls normal to the plane of the field at points X and Y would then, in theory, receive no luminous flux, as can be seen from the path of the beams. The permitted variation in the distance between the operating field and the device is thus delimited by points O' and O''. The frusto-conical area in which illumination is adequate is shown by a hatched cross-section XY $X_a$ $Y_a$ and the upper and lower bases of this area have as their centres O' and O''. Points situated within walls X $X_a$ and Y $Y_a$ thus receive luminous flux from at least one of the beams 17, 18 or 19. The lines $XX_a$ and $YY_a$ are situated on the straight lines B'X and BY which correspond to the outer edge of the most divergent beam.

Attempts have however been made to increase the distance O'O'' in order to make the device easier to use by reducing the accuracy with which it needs to be set up. In FIG. 7*b* is shown a beam path in which beams 18 and 19 are still reflected onto the whole of field XY but in which the outside beam 17 is reflected onto a central portion $X_1$ $Y_1$ of field XY. It can be seen that, due to this fact, the useful volume XY $X_b$ $Y_b$ is delimited by segments $XX_b$ and $YY_b$ of straight lines $C'XX_b$ and $CYY_b$ which are less divergent in relation to the axis of the device than the straight lines $B'XX_a$ and $BYY_a$ in the previous configuration. The luminous flux is thus less divergent and it can be seen that the distance O'O'' at which illumination on area $X_b$ $Y_b$ is still adequate is greater than the distance which separated planes $X_a$ $Y_a$ and XY in FIG. 7*a*. Configuration 7*b* is better suited to rapid deployment than configuration 7*a* but it provides weaker illumination of the vertical walls of a cavity.

FIG. 7*c* is a diagram of a configuration in which the inside beams 18 and 19 are still reflected onto the whole of field XY as in the previous configuration but in which the outer beam 17 is reversed for the purpose of directing it toward field XY. The prism situated at A reflects the light onto the edge Y of the field, the prism situated immediately inwards of prism A reflects light onto a point situated next to Y in the direction of extremity X, and so on in the case of all the prisms until B is reached where the light is reflected onto X.

In this case it can be seen that the useful volume $XYX_cY_c$ is much more divergent than in previous cases and that the distance O'O'' between planes XY and $X_cY_c$ is much smaller. Unlike configuration 7*b*, configuration 7*c* calls for the device to be accurately set up but provides far stronger illumination of the vertical walls.

There is a large number of configurations and the three above are only given as examples. This shows the advantages of using straight prisms in the device, thereby allowing the light to be distributed in the desired way over the field area, without the necessity for making allowance for the focussing of the light at the centre of the field.

In all the foregoing it was assumed that the device was fitted with three light sources but it is understood that there may be any number of sources.

What is claimed is:

1. An illuminating device intended to illuminate the operating field of an operating table with substantially uniform intensity comprising:

at least one light source emitting light beams, a toroidal optical system, adapted to receive said light beams, and said light source being located substantially on the axis of and above said toroidal system, a plate member having a center and so located beneath said toroidal system that said light beams, passing through said toroidal system, impinge thereon, a prism assembly on said plate, said assembly being made of a plurality of juxtaposed straight prisms, each said prism having an axis and at least one reflective face, each said axis of each said prism being parallel to a plane, said prisms combining in a plurality of sectors, the vertices of which are substantially located in the center of said plate, the light source, the center of said plate and the center of said operating field being substantially aligned and said light beams from said light source impinging on said operating field through said toroidal system and said prism assembly.

2. An illuminating device as claimed in claim 1, in which said sector has an angular extent of such a value that the reflected light beams form on said operating field a trace having a width which is substantially the same as that of the field.

3. An illuminating device as claimed in claim 1, in which said reflective face of each prism is so orientated as to reflect the light onto a predetermined part of the field.

4. An illuminating device as claimed in claim 3, in which the said straight prisms situated on the outer periphery of the prism assembly reflect the light onto the opposite outer section. of the operating field.

* * * * *